US005306105A

United States Patent [19]

Langbrandner et al.

[11] Patent Number: 5,306,105

[45] Date of Patent: Apr. 26, 1994

[54] STREET MARKING STRIP

[76] Inventors: Josef Langbrandner, Lerchenweg 5, 8411 Deuerling; Alfred Seisenberger, Thannstr. 28a, 8501 Allersberg; Theo Trimborn, Delle 33, 5338 Bad Münstereifel, all of Fed. Rep. of Germany

[21] Appl. No.: 892,030

[22] Filed: Jun. 2, 1992

[30] Foreign Application Priority Data

May 7, 1992 [JP] Japan ..... 4-114771

[51] Int. Cl.[5] ..... E01F 9/06

[52] U.S. Cl. ..... 404/12

[58] Field of Search ..... 404/12-13, 404/82, 14, 15; 428/906, 283, 285-291, 323, 325, 328; 116/63 R, 63 P

[56] References Cited

U.S. PATENT DOCUMENTS

| | | | |
|---|---|---|---|
| Re. 31,669 | 9/1984 | Eigenmann | 404/124 |
| 2,579,467 | 12/1951 | Brickman | 404/12 |
| 4,080,228 | 3/1978 | Currigan | 404/124 |
| 4,146,635 | 3/1979 | Eigenmann | 404/124 |
| 4,993,868 | 2/1991 | Eigenmann | 404/14 X |
| 5,013,181 | 5/1991 | Harrison | 404/12 |

FOREIGN PATENT DOCUMENTS 3905597 9/1990 Fed. Rep. of Germany .

*Primary Examiner*—Kenneth J. Dorner
*Assistant Examiner*—Nancy Mulcare
*Attorney, Agent, or Firm*—Bacon & Thomas

[57] ABSTRACT

A street marking strip device formed of a resilient and flexible strip material includes a traffic marking on a visible side thereof and a street engaging underside having longitudinally extending clearances and cavities separated by longitudinally extending contact edge zones for releasably engaging a street surface. The strip material optionally may include longitudinally extending reinforcement elements in the form of strand or sheet material and may include prestressing elements for giving the strip material an overall concave shape when it is in its unloaded condition. When the prestressed strip material engages a street surface, a clawing action results as the strip material is flattened against the street surface. The strip material may be readily released from the street surface and reused again. The strip material includes tapered flanks to ensure smooth traversal by automobiles.

32 Claims, 7 Drawing Sheets

STREET MARKING STRIP

BACKGROUND OF THE INVENTION

The invention concerns a street marking-device consisting of a rubber or flexible-plastic marker strip with traffic marking and which in use is self-secured to the street surface, with the bond between the strip and the street surface being disengageable and renewable.

Such a marking device already is generally known from German patent No. 39 05 597 C2. When used to mark street surfaces, this known marking device is wound off a roll onto the street pavement, with the adhesion between the marking device and the street pavement being assured solely by the weight of the marking device. No further adhesion or bonding exists between the marking device and the street pavement. To assure good positional stability during use, the known marking device has a high specific gravity and when not loaded by traffic is prestressed transversely about its longitudinal axis so as to curve concavely relative to the street pavement.

BRIEF SUMMARY OF THE INVENTION

The object of the present invention is to further improve the positional stability of the marking device, particularly when a vehicle is driving over it.

This object is achieved by the invention in that the marking-device side facing the street pavement (i.e., the surface profile facing the street) comprises longitudinal clearances and in that the marking-device segments between the longitudinal clearances are made concave whereby contact edges are created at least sectionally between the longitudinal clearances and the concave zones. When a vehicle drives over the marking device, these contact edges act in position-stabilizing manner and preclude unintended shifting of the marking device on the street surface. Another advantage is provided in that, when being put in place, the marking device evinces substantially improved stability regarding sideways shifting and as a result even curved lines can be laid in simplified manner. The contact edges also prevent sand particles and the like from imparting a rolling surface for the marking device relative to the street surface, such rolling motion, of course, degrading positional stability both when the marking device is put in place and when a vehicle drives over it. Moreover, the longitudinal clearances together with the concave zones provide good draining for wet streets or in case of rain.

In a further embodiment of the invention, an edge zone is provided on the street side of the marking device between the outer edge of the marking device and the profile consisting of longitudinal clearances and concave zones, with the edge zone at least lying flat on the street surface when the marking device is vehicle-loaded so that the behavior of the marking device when being traveled on is improved with simultaneous reduction in the stresses on its side zones.

Said travel behavior is still further improved by providing upper sides for the marking device that slope upwardly from the side edges of the top surface.

In a further embodiment, the marker strip is prestressed as a whole so that in its unloaded state it evinces an overall concave curvature along its bottom or street side, as a result of which only the outer edges of the marking device contact the street pavement when the device is laid out, and also evinces an additional clawing, abrading or gripping effect achieved by the contact edges when a vehicle rides over the marking device.

This clawing effect is further improved on one hand when a vehicle rides on the marking device, or else, for a marker strip that as whole is not prestressed, on the other hand it is assured thereby that the marker strip shall be prestressed or reinforced in the particular concave zone, so that when vehicle-loaded, an additional forced superposed on the elasticity of the marker strip shall come into play and entail increased clawing, resulting in an overall optimum adhesion of the marking device on the street pavement.

The prestressing or reinforcement preferably is implemented by suitable insets. These insets may be molded simultaneously in simple manner during a continuous manufacturing procedure (e.g., extrusion).

Preferably, the insets consist of elastic, prestressed material, for instance spring steel, to assure prestressing.

However, and alternatively, the particular concave zone may be prestressed by the deposition of additional material under tension to produce such prestressing. Because of its tension, the additional material contracts and imparts prestressing to the strip material along the concave zone.

Because the contact edges are at least partly structural (i.e., capable of carrying load), the total effective area of the contact edges is increased and hence the tendency of the marking devices to stretch longitudinally and/or to buckle is reduced, especially when a vehicle rides on them. Such longitudinal expansion and buckling is especially significant when the vehicle riding over the marking device in its longitudinal direction is being braked, as a result of which, in the worst case, the marking device would buckle and rise in front of the braked wheel; that is, the device would corrugate. This danger is reduced by the structure of the contact edges.

Such a structure can be appropriately and simply made by endowing the contact edges with a serrated shape. The serrate shape can be easily manufactured by an extruder die moving transversely to the extrusion direction.

In a special embodiment designed to avoid the longitudinal expansion or buckling of the strip which is especially dangerous during vehicle braking, the marker strip comprises insets in the form of twisted strands extending over the entire length of the marking devices. These twisted strands can be integrated in simple manner by extrusion, and, on account of their twisting, form a rigid unit with the marker strip. Moreover the twisting assures retaining the strands even after some time of intensive use.

In a further implementation of the present invention, the marker strip comprises insets in the form of plastic cables extending over the entire length of the marking devices and with diameters preferably 4.0 to 6.0 mm. The plastic cables are extruded simultaneous and with the marker strip and are bonded to the marker strip material.

In order to achieve the total prestressing of the marking device on one hand and on the other hand to prevent the strip from expanding longitudinally or buckle during vehicle braking, the marker strip may be fitted with a flat, longitudinal inset of a flexible material such as spring-steel sheetmetal. Where the marking device is intended only for straight markings, the longitudinal inset may extend over a wide cross-section of the marking device.

In such an embodiment, a perforated sheetmetal is used as the inset, its individual perforations preventing excessive lengthwise stretching of the strip on account of the retaining effect in the vicinity of the particular perforations especially when the marking device is under vehicle loading. To ensure adequate cross-flexibility of the marking device fitted with the perforated sheetmetal, the thickness of this sheetmetal should preferably be in a range of 0.1 to 0.3 mm, preferably 0.2 mm in the invention.

For improved positional stability of the marking device, the material comprising the marker strip may include heavy-metal additions, for example lead.

The marking device, that is the marker strip, shall also evince a transverse flexibility allowing its laying along curves.

Appropriately, the marking device comprises a coupling means at each end to attach to neighboring marking devices. A coupling device may be a Velcro type coupling. Alternatively, the coupling means may be a specifically shaped molded plastic part that can mate with another matching or complementary plastic part of the adjacent marking device.

The marking device may be made highly visible by either providing a luminous layer at the top side of the marker strip or by the entire marker strip being dyed.

DESCRIPTION OF THE DRAWINGS

The invention is illustrated below by means of several embodiments shown in the drawings, wherein.

FIGS. *7a* and *7b* schematically show coupling means to link individual marking-device segments.

DETAILED DESCRIPTION OF THE PREFERRED EMBODIMENT

The same features are denoted by the same references which for the sake of clarity shall be shown as a rule only once per Figure.

Figure 1:
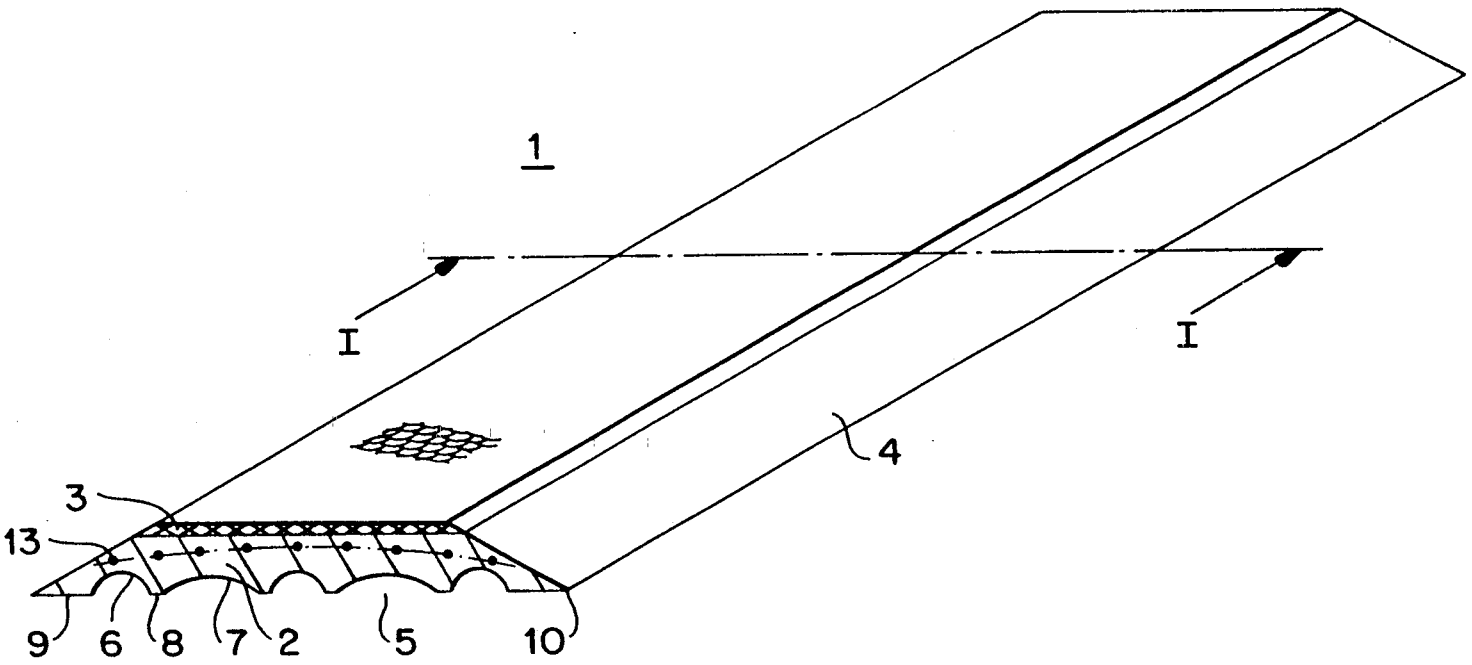
FIG. 1 is a segment of a marking device of the invention as if resting on a planar surface (not shown)

In FIG. 1, 1 denotes the marking device shown as a whole. The marking device comprises a marker strip 2 preferably made of rubber or flexible plastic and of such thickness as to allow rolling up the strip 2.

The marker strip 2 is sufficiently flexible in the transverse direction to allow laying curved marking lines. Moreover the material of the marker strip, for example rubber or flexible plastic, evinces a relatively high specific gravity in order to improve the marking device positional stability or that of the marking line formed by the marking device 1.

The high specific gravity of the marker strip is appropriately achieved by adding heavy metals, in particular lead, to the strip.

At its top side, the marker strip is fitted with a luminous layer 3 serving as the marking means. Alternatively the strip 2 itself may be dyed.

The marking device 1 comprises upwardly sloping flanks 4 allowing a vehicle to smoothly ride over it and precluding shifting or slipping as the vehicle rides onto it.

Longitudinal clearances or grooves 6 are provided at the underside 5 of the marking device 1 and serve as drainage means, that is, they drain rain water which collects underneath the marking device 1. For purposes of illustration, FIG. 1 merely shows three longitudinal clearances, but it is clear that many more longitudinal clearances 6 may be present in practice. Concave zones 7 are provided between the individual longitudinal clearances 6 and are designed in such a way that edges 8 are produced between the longitudinal clearances 6 and the concave zones 7, said zones themselves being longitudinal.

The edges 8 may run over the entire length of the marking device 1 or only in part.

The edges 8 cause a gripping or clawing action of the underside 5 of the marking device 1 into the street pavement and thereby assure increased anti-shift behavior both when a vehicle rides over the marking device 1 and during its laying to the extent that the marking device is not prestressed as a whole.

Side edge zones 9 are located between the outer edges 10 of the strip 2 and the outer longitudinal clearances 6 and, at least when under vehicle-load, the strip will make two-dimensional contact with the street surface.

A plurality of strands 13 molded into the marking device during extrusion are present along the marking-device's cross-section and ensure that longitudinal expansion or buckling is prevented or reduced during vehicle braking while engaging the strip. The strands are in the form of twisted strands 13 or as especially twisted plastic cables with a diameter of 4 to 6 mm and on that account assure improved bonding between the strands and the marker strip material 2. Preferably the strands extend along the entire length of the marking device 1.

Figure 2:
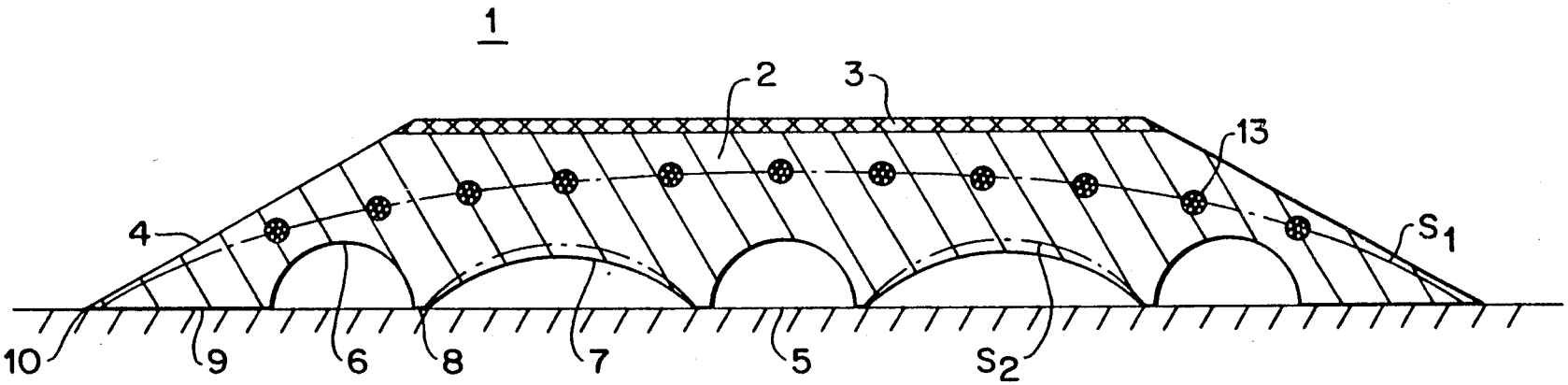
FIG. 2 is a cross-section of the marking device of FIG. 1 along line I—I in the absence of prestressing of the overall marking device, or in the presence of prestressing of the overall marking device but in the vehicle-loaded state.

As shown by FIG. 2, the strands 13 are arrayed across an imaginary line S1 which in the event of a prestressed marking device (which shall be further discussed below) represents the stress line in the vehicle-loaded state of the marking device.

Again the concave zones 7 may be endowed with separate prestressing denoted by imaginary line S2 which is the prestressed curvature of the concave zone.

The additional prestressing of the marker strip 2 in the concave zones 7 ensures an additional force, which is in addition to the elasticity of the marker strip 2, acts at the edges 8 and further increases the anti-shift properties of the marking device 1 when a vehicle rides over it.

Figure 3:
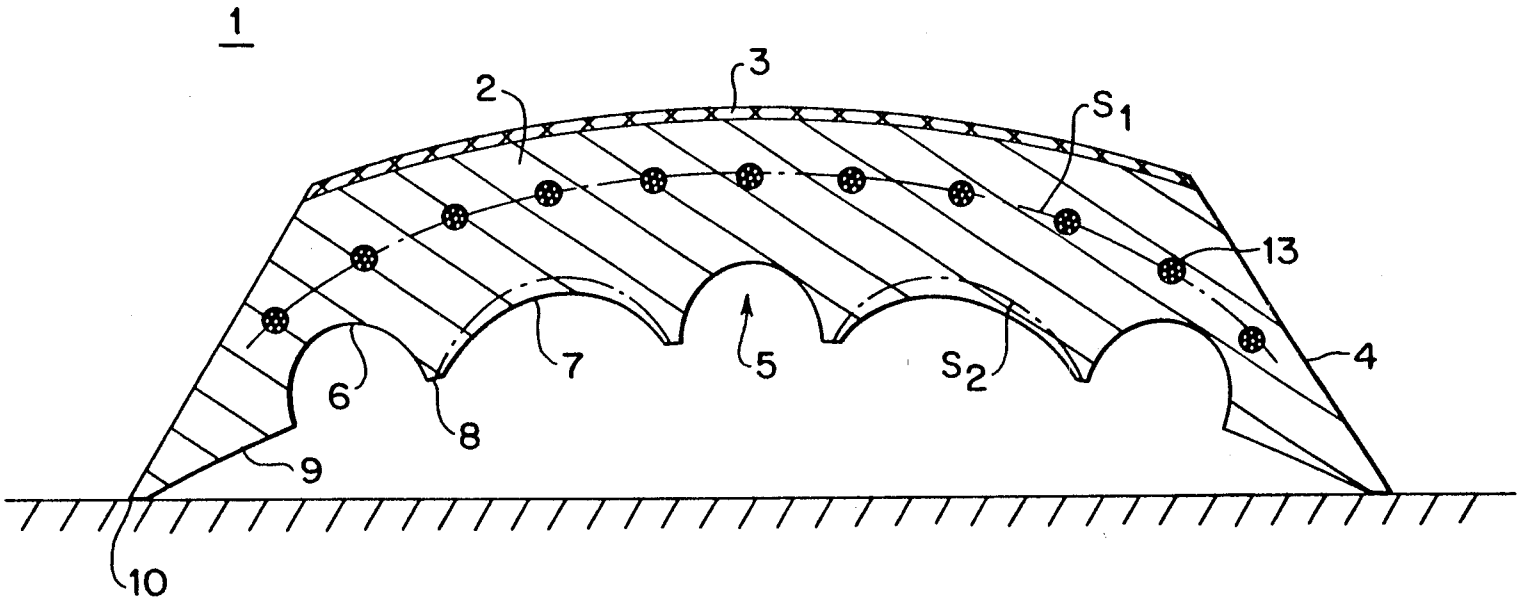
FIG. 3 is the marking device of FIGS. 1 and 2 in its unloaded state, the overall marking device being prestressed.

FIG. 3 shows a marking device 1 which is prestressed as a whole in such a way that in its unloaded state it evinces an overall concave form along its underside 5. Accordingly, when unloaded, the marking device 1 rests merely on its outside edges 10, as a result of which a clawing effect is achieved during laying of the strip on a pavement.

The prestress curvature lines S2 of the individual concave zones 7 are more curved in the unloaded state shown in FIG. 3. For the sake of clarity, the marking device of FIG. 3 is shown with somewhat exaggerated overall curvature. Because of its own weight, the marking device 1 assumes only a slight residual curvature at its underside 5 when resting on the street surface in its vehicle-free or unloaded state. The purpose of the overall curvature merely is to assure some clawing at the vicinity of the outer edges.

However it is specifically emphasized in this respect that prestressing of the entire marking device of the kind shown in FIG. 3 need not be implemented in its alternative embodiment.

Figure 4:
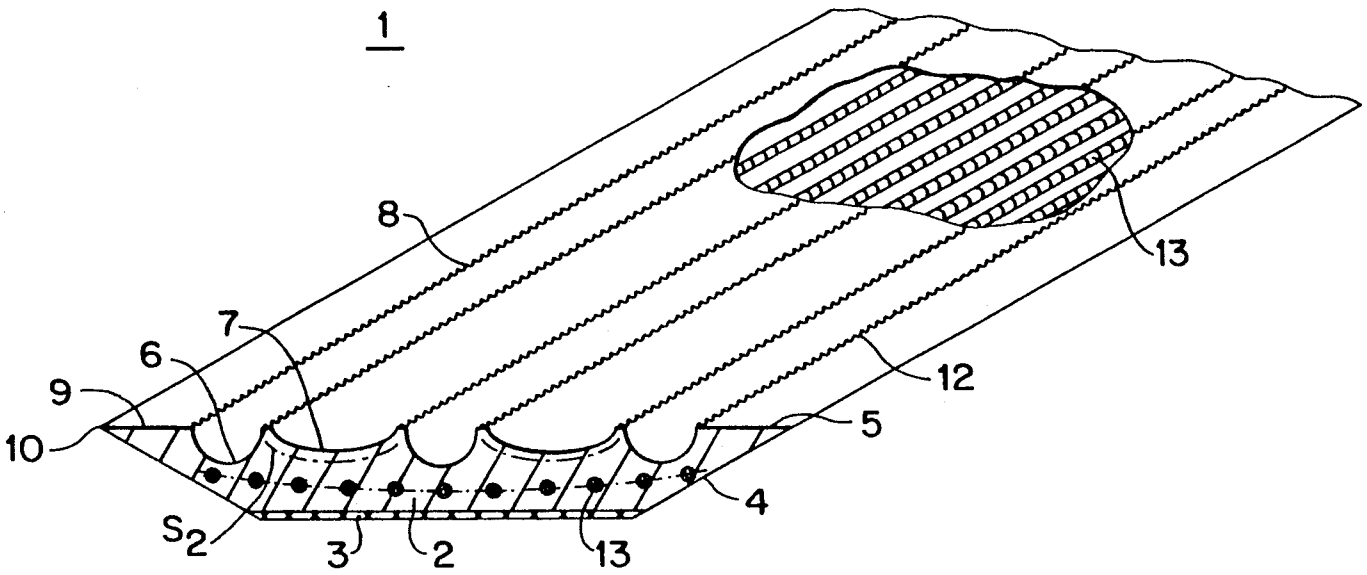
FIG. 4 is the marking device of the above Figures when rotated by 180° and shown from below.

FIG. 4 shows the underside 5 of the marking device 1, with the pavement contact edges 8 being profiled in the form of serrations 12 to further impede shifting of the marking device and thereby to increase its positional stability when a vehicles rides over it, on one hand, and on the other hand, if the marking device is not prestressed, increasing the positional stability during laying of the marking device. FIG. 4 shows further that the individual, twisted strands 13 are continuous along the entire length of the marking device 1.

Figure 5:
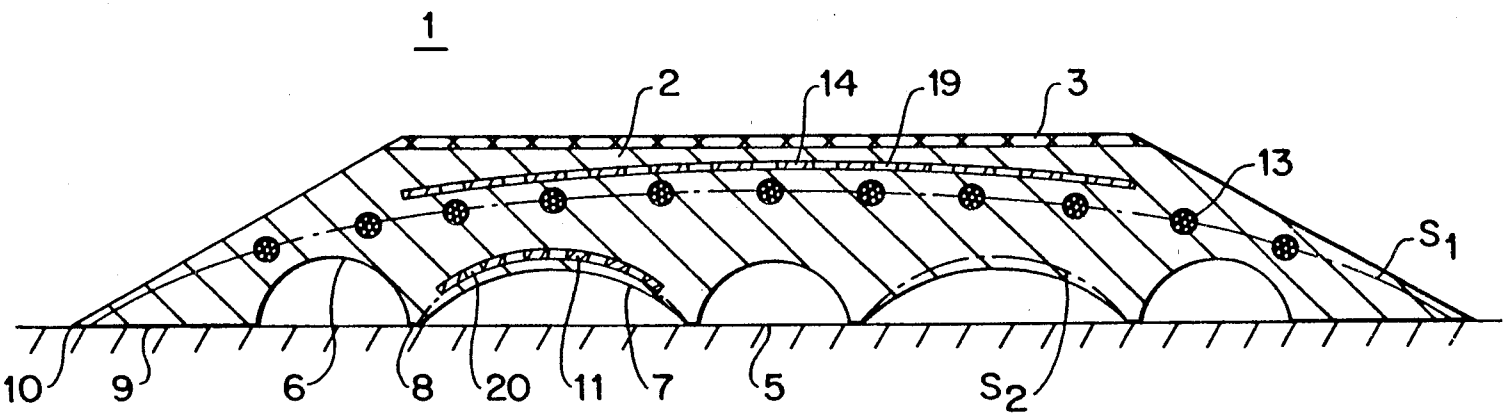
FIG. 5 is a cross-section, corresponding to that of FIG. 2, of another embodiment of the marking device of the invention.

FIG. 5 shows another embodiment of the marking device 1 of the invention, the same references denoting the same features. Reference 14 denotes a perforated sheetmetal longitudinally extending along the material of the marking device 1 and preventing longitudinal stretching of the marking device 1. This is implemented by the engagement of the individual perforations 19 with the surrounding material of the marker strip 2, in particular when the marking device 1 is vehicle-loaded. The perforated sheetmetal is about 0.1 to 0.3 mm thick to assure adequate transverse flexibility.

Moreover, the perforated sheetmetal 14 may be used to impart overall prestressing to the marking device 1. Also, in the embodiment mode of FIG. 5, there are insets 11 in certain or all concave zones 7, whereby the concave zones are additionally prestressed relative to the remaining strip. For the sake of simplicity, only one inset 11 is shown in FIG. 5. S2 denotes the prestress line in the concave zone 7.

Alternatively, the resting pressure in the vicinity of the contact edges 8 also can be enhanced by the insets 11 providing no prestressing but merely serving as simple insets to hamper the flattening of the concave zones 7 during vehicle-load and thereby also assuring an increase in pressure in the vicinity of the rest edges 8.

Figure 6:
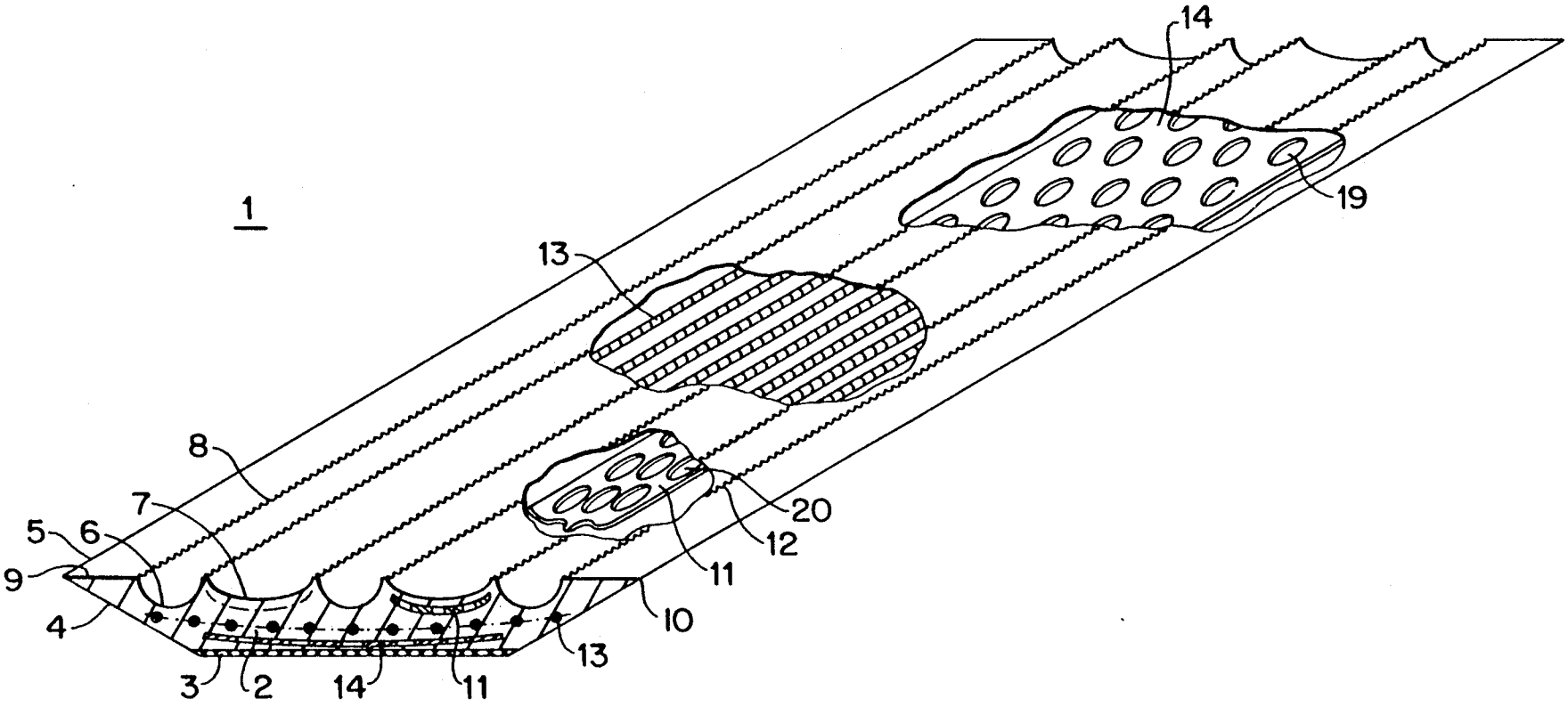
FIG. 6 shows the marking device of FIG. 5 inverted.

FIG. 6 shows the underside of the marking device of FIG. 5, the individual cutaways representing the perforated sheetmetal 14 with perforations 9, the individually continuous twisted strands 13 and the inset 11 which for the sake of clarity is shown only at one side. The inset also is provided with individual perforations 20 in order to decrease the longitudinal stretching. As already mentioned, the inset 11 may serve merely as reinforcement for the concave zone 7, or it may provide additional prestressing for the concave zone 7. If it is desired to prestress the concave zone, then the inset 11 used shall appropriately be made of a spring steel sheetmetal.

Figure 7A:
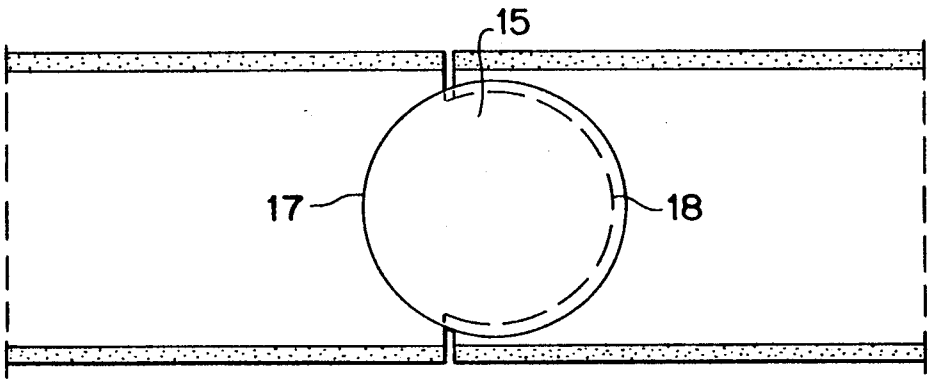
Figure 7B:
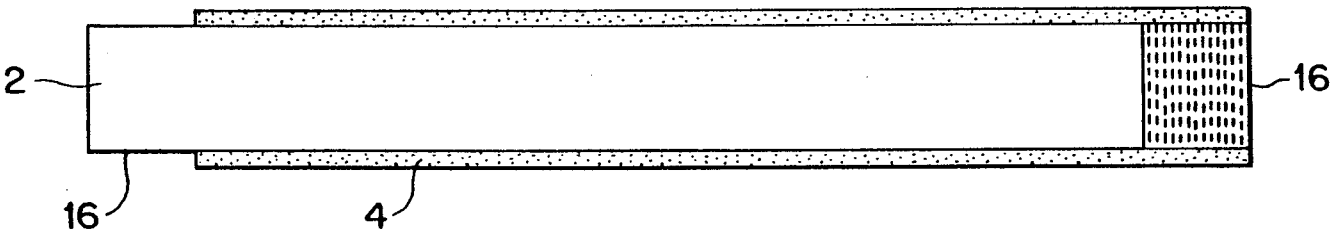

FIGS. 7*a* and 7*b* merely show in a simple, schematic manner, two different coupling parts to link together two marking devices 1. The marking devices 1 are understood to be one of the above described embodiments. FIG. 7*a* shows a coupling part 15 consisting of two mutually engaging and relatively pivotable shaped plastic parts 17 and 18 serving to link two marking devices 1. This design offers the advantage that the two marking devices 1 can be pivoted relative to each other. The coupling part 15 moreover can be made heavier to further enhance the positional stability of the laid marking device or the marked line. FIG. 7*b* shows a coupling part in the form of a Velcro or similar gripping type material on each of the left and right sides of the marking device 1, the right side being mounted to the underside of a projecting segment of the marking device 1.

The description is illustrative only and in not intended to limit the scope of the invention as defined in the following claims.

We claim:

1. A street marking strip device comprising a flexible and resilient strip material capable of being rolled up and having traffic marking means thereon, said strip material having a street engaging side including longitudinally extending, laterally separated clearances (6) and concavities (7); and longitudinal contact edge zones (8) disposed between said clearances and concavities, said edge zones adapted to releasably engage a street surface; said strip material having side edges, and including longitudinal side edge contact zones (9) on the street engaging side of the strip material between each side edge of the strip material and the next adjacent clearance or concavity; said marker strip including longitudinal side edges and an upper side opposite said street engaging side, and upwardly sloping flanks between said side edges and the upper side of the strip material.

2. A street marking strip device as claimed in claim 1, wherein said street engaging side is longitudinally concavely bowed when the strip is in its unloaded condition.

3. A street marking device as claimed in claim 2, including means for prestressing the strip material adjacent at least one concavity into a predetermined curvature that is more concave than the curvature of the concavity in its loaded state, whereby the adjacent contact edges are biased towards the street surface when the street engaging surface of the strip material is extended flat against the street surface.

4. A street marking strip device as claimed in claim 3, wherein said means for pretensioning includes longitudinal prestressing elements inserted in the strip material adjacent said concavities.

5. A street marking strip device as claimed in claim 4, wherein said prestressing elements comprise elastic material.

6. A street marking strip device as claimed in claim 3, wherein said prestressing means comprises longitudinally extending prestressing elements disposed within the strip material.

7. A street marking strip device as claimed in claim 1, wherein said contact edges include a profile that provides a discontinuous contact with a street surface.

8. A street marking strip device as claimed in claim 7, wherein said profile of said contact edges are formed as serrations.

9. A street marking strip device comprising a flexible and resilient strip material capable of being rolled up and having traffic marking means thereon, said strip material having a street engaging side including longitudinally extending, laterally separated clearances (6) and concavities (7); and longitudinal contact edge zones (8) disposed between said clearances and concavities, said edge zones adapted to releasably engage a street surface; and including longitudinally extending reinforcement strand material within the strip material.

10. A street marking strip device as claimed in claim 9, wherein said strand material comprises twisted cable.

11. A street marking strip device as claimed in claim 9, wherein said strand material comprises plastic cables.

12. A street marking strip device as claimed in claim 11, wherein said cables are 0.3–0.6 mm in diameter.

13. A street marking strip device as claimed in claim 1, including longitudinally extending flexible reinforcement sheet material within the strip material.

14. A street marking strip device as claimed in claim 13, wherein said sheet material is perforated sheet metal.

15. A street marking strip device as claimed in claim 14, wherein sheet metal has 5.0–6.0 mm thickness.

16. A street marking strip device as claimed in claim 1, including weighting means in the strip material for increasing the mass of the strip material.

17. A street marking strip device as claimed in claim 16, wherein said weighting means comprises lead.

18. A street marking strip device as claimed in claim 1, wherein said strip material is sufficiently flexible to permit laying of same on a street surface in a laterally curved pattern.

19. A street marking strip device as claimed in claim 1, wherein said strip material is of predetermined length, and includes a coupling means at each end thereof for engaging a corresponding coupling means on an adjacent similar length of marking strip material.

20. A street marking strip device as claimed in claim 19, wherein said coupling means comprises Velcro fastening material.

21. A street marking strip material as claimed in claim 19, wherein said coupling includes a geometrically shaped feature for engaging a complementary geometrically shaped feature on a coupling means associated with an adjacent similar length of marking strip material.

22. A street marking strip device as claimed in claim 1, wherein strip material includes a highly visible street marking material on an upper, non-street engaging side thereof, said street marking material comprising a layer superimposed on the strip material.

23. A street marking devices as claimed in claim 1, wherein the marker strip material is a highly visible colored material throughout.

24. A street marking strip device comprising a flexible and resilient elongate strip material capable of being rolled up and having traffic marking means thereon, said strip material having a street engaging side including longitudinally extending, laterally separated clearances (6) and concavities (7); and longitudinal contact edge zones (8) disposed between said clearances and concavities, said edge zones adapted to releasably engage a street surface; said clearances and concavities comprising continuously extending depressions in the street engaging side of the strip material extending parallel to the longitude of the strip material, and wherein said clearances and concavities have geometric contours different from each other as viewed in transverse cross section of the strip material.

25. A street marking strip device as claimed in claim 24, said strip material having side edges, and including longitudinal side edge contact zones (9) on the street engaging side of the strip material between each side edge of the strip material and the next adjacent clearance or concavity.

26. A street marking strip device as claimed in claim 24, said marker strip including longitudinal side edges and an upper side opposite said street engaging side, and upwardly sloping flanks between said side edges and the upper side of the strip material.

27. A street marking device as claimed in claim 24, including means for prestressing the strip material adjacent at least one concavity into a predetermined curvature that is more concave than the curvature of the concavity in its loaded state, whereby the adjacent contact edges are biased towards the street surface when the street engaging surface of the strip material is extended flat against the street surface.

28. A street marking strip device as claimed in claim 24, wherein said means for pretensioning includes longitudinal prestressing elements inserted in the strip material adjacent said concavities.

29. A street marking strip device as claimed in claim 24, wherein said contact edges include a profile that provides a discontinuous contact with a street surface.

30. A street marking strip device as claimed in claim 24, including longitudinally extending reinforcement strand material within the strip material.

31. A street marking strip device as claimed in claim 24, including longitudinally extending flexible reinforcement sheet material within the strip material.

32. A street marking strip device as claimed in claim 1, including longitudinally extending reinforcement strand material within the strip material.

* * * * *